US006149489A

United States Patent [19]

Johnson

[11] Patent Number: 6,149,489

[45] Date of Patent: Nov. 21, 2000

[54] INFANT AMUSEMENT DEVICE

[76] Inventor: Russell G. Johnson, 7322 Roadrunner La., Humble, Tex. 77396

[21] Appl. No.: 09/288,122

[22] Filed: Apr. 8, 1999

[51] Int. Cl.[7] ..... A63H 33/00; A47C 4/52

[52] U.S. Cl. ..... 446/227; 446/485; 297/183.1; 297/183.9; 434/258

[58] Field of Search ..... 446/227, 175, 446/485, 491; 434/258; 362/190, 184, 806; 297/188.2, 183.1, 256.1, 256.16, 183.2, 183.3, 183.4, 183.9; 248/229.24, 229.25, 228.6, 230.6, 231.71; D3/213

[56] References Cited

U.S. PATENT DOCUMENTS

| | | | |
|---|---|---|---|
| 3,978,610 | 9/1976 | Stubbmann | 446/227 |
| 4,508,511 | 4/1985 | McQueen | 446/485 |
| 4,540,219 | 9/1985 | Klinger | 446/227 |
| 5,522,639 | 6/1996 | Jaime | 297/183.3 |
| 5,544,935 | 8/1996 | Cone, II et al. | 297/183.4 |
| 5,651,581 | 7/1997 | Myers et al. | 297/183.1 |
| 5,653,529 | 8/1997 | Spocharski | 362/806 |
| 5,709,582 | 1/1998 | O'Donnell | 446/227 |

*Primary Examiner*—Jacob K. Ackun
*Assistant Examiner*—Urszula M. Cegielnik

[57] ABSTRACT

A infant amusement device for providing amusement and entertainment to an infant by sequentially illuminating a series of multi-colored light sources. The infant amusement device includes an elongate housing designed for mounting to a carry handle of an infant carrier. The housing has a plurality of spaced apart light sources therein. A sequence controller is disposed in the housing and is electrically connected to each of the light sources. The sequence controller illuminates the light sources in a sequential series.

20 Claims, 3 Drawing Sheets

25
15
27
11
27
26
10

10
18a
27
18b
15
18c
11
18d
27
18e
24
13
RED
BLUE
GREEN
ORANGE
YELLOW
14
25
16

INFANT AMUSEMENT DEVICE

BACKGROUND OF THE INVENTION

1. Field of the Invention

The present invention relates to devices for amusing and entertaining infants and more particularly pertains to a new infant amusement device for providing amusement and entertainment to an infant by sequentially illuminating a series of multi-colored light sources.

2. Description of the Prior Art

The use of devices for amusing and entertaining infants is known in the prior art. More specifically, devices for amusing and entertaining infants heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,508,511; 5,057,051; 4,973,286; 3,036,404; 1,900,353; EPO Patent No. EP 0 767 068 A2; and PCT Patent No. WO 93/10872.

While these devices fulfill their respective, particular objectives and requirements, the aforementioned patents do not disclose a new infant amusement device. The inventive device includes an elongate housing designed for mounting to a carry handle of an infant carrier. The housing has a plurality of spaced apart light sources therein. A sequence controller is disposed in the housing and is electrically connected to each of the light sources. The sequence controller illuminates the light sources in a sequential series.

In these respects, the infant amusement device according to the present invention substantially departs from the conventional concepts and designs of the prior art, and in so doing provides an apparatus primarily developed for the purpose of providing amusement and entertainment to an infant by sequentially illuminating a series of multi-colored light sources.

SUMMARY OF THE INVENTION

In view of the foregoing disadvantages inherent in the known types of devices for amusing and entertaining infants now present in the prior art, the present invention provides a new infant amusement device construction wherein the same can be utilized for providing amusement and entertainment to an infant by sequentially illuminating a series of multi-colored light sources.

The general purpose of the present invention, which will be described subsequently in greater detail, is to provide a new infant amusement device apparatus and method which has many of the advantages of the devices for amusing and entertaining infants mentioned heretofore and many novel features that result in a new infant amusement device which is not anticipated, rendered obvious, suggested, or even implied by any of the prior art devices for amusing and entertaining infants, either alone or in any combination thereof.

To attain this, the present invention generally comprises an elongate housing designed for mounting to a carry handle of an infant carrier. The housing has a plurality of spaced apart light sources therein. A sequence controller is disposed in the housing and is electrically connected to each of the light sources. The sequence controller illuminates the light sources in a sequential series.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new infant amusement device apparatus and method which has many of the advantages of the devices for amusing and entertaining infants mentioned heretofore and many novel features that result in a new infant amusement device which is not anticipated, rendered obvious, suggested, or even implied by any of the prior art devices for amusing and entertaining infants, either alone or in any combination thereof.

It is another object of the present invention to provide a new infant amusement device which may be easily and efficiently manufactured and marketed.

It is a further object of the present invention to provide a new infant amusement device which is of a durable and reliable construction.

An even further object of the present invention is to provide a new infant amusement device which is susceptible of a low cost of manufacture with regard to both materials and labor, and which accordingly is then susceptible of low prices of sale to the consuming public, thereby making such infant amusement device economically available to the buying public.

Still yet another object of the present invention is to provide a new infant amusement device which provides in the apparatuses and methods of the prior art some of the advantages thereof, while simultaneously overcoming some of the disadvantages normally associated therewith.

Still another object of the present invention is to provide a new infant amusement device for providing amusement and entertainment to an infant by sequentially illuminating a series of multi-colored light sources.

Yet another object of the present invention is to provide a new infant amusement device which includes an elongate housing designed for mounting to a carry handle of an infant carrier. The housing has a plurality of spaced apart light sources therein. A sequence controller is disposed in the housing and is electrically connected to each of the light sources. The sequence controller illuminates the light sources in a sequential series.

Still yet another object of the present invention is to provide a new infant amusement device that may be mounted to the carry handle of an infant carrier or even integrally formed with the carry handle to provide an amusing and entertaining light show to an infant in the infant carrier.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
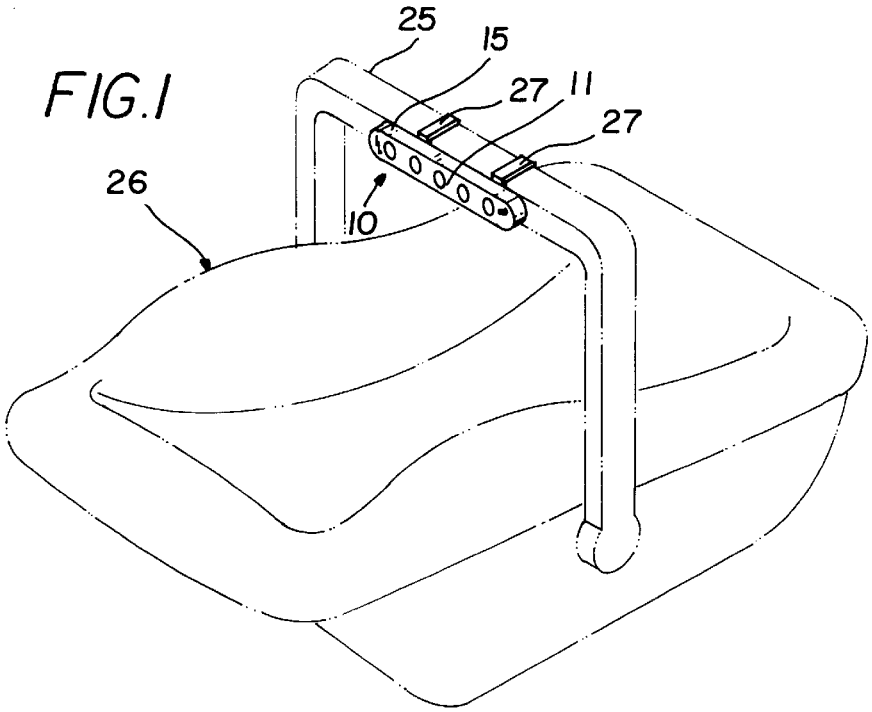
FIG. 1 is a schematic perspective view of a new infant amusement device in use on a carry handle of an infant carrier according to the present invention.
Figure 2:
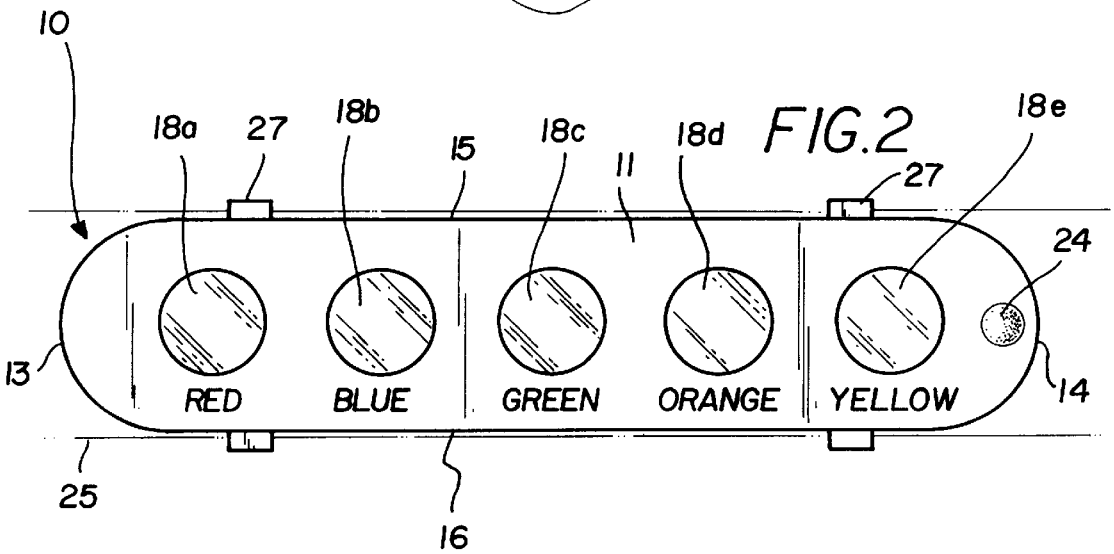
FIG. 2 is a schematic front view of the present invention on a carry handle of an infant carrier.

With reference now to the drawings, and in particular to FIGS. 1 through 5 thereof, a new infant amusement device embodying the principles and concepts of the present invention will be described.

As best illustrated in FIGS. 1 through 5, the infant amusement device generally comprises an elongate housing designed for mounting to a carry handle of an infant carrier. The housing has a plurality of spaced apart light sources therein. A sequence controller is disposed in the housing and is electrically connected to each of the light sources. The sequence controller illuminates the light sources in a sequential series.

In closer detail, the infant amusement device comprises an elongate housing 10 having front and back faces 11,12, a pair of opposite ends 13,14 and top and bottom sides 15,16 extending between the ends of the housing. Preferably, the front and back faces of the housing lie in substantially parallel planes with one another. In this preferred embodiment, the top and bottom sides of the housing lie in substantially parallel planes with one another substantially perpendicular to the planes of the front and back faces of the housing. Ideally, the ends of the housing are rounded and has concavities facing one another for reducing the number of sharp edges of the housing. The housing has a length defined between the ends of the housing, a width defined between the top and bottom sides of the housing and a depth defined between the front and back faces of the housing. In an ideal illustrative embodiment, the length of the housing is about 6 inches, the width of the housing is about 2 inches, and the depth of the housing is about 1 inch.

The front face of the housing has a plurality of spaced apart light sources 17*a*,17*b*,17*c*,17*d*,17*e* therein. The light sources each may comprise a light bulb or a light emitting diode (LED). Preferably, the front face of the housing has a plurality of translucent windows 18*a*,18*b*,18*c*,18*d*,18*e* with each light source positioned adjacent a corresponding window. Preferably, the windows each have a generally circular outer perimeter. Ideally, the windows are arranged in a row on the front face of the housing extending between the ends of the housing with the centers of the windows coaxially aligned with one another in the row.

Each of the windows is tinted a color such that light from the adjacent corresponding light source passing through the respective window is colored. The color of each window is visually distinguishable from the colors of the other windows. Optionally, the light sources may be each tinted the respective color instead of the windows with the windows being generally clear in color. In an ideal embodiment, a first window 18*a* may be tinted a red color, a second window 18*b* may be tinted a blue color, a third window 18*c* may be tinted a green color, a fourth window 18*d* may be tinted a orange color, and a fifth window 18*e* may be tinted a yellow color.

Figure 3:
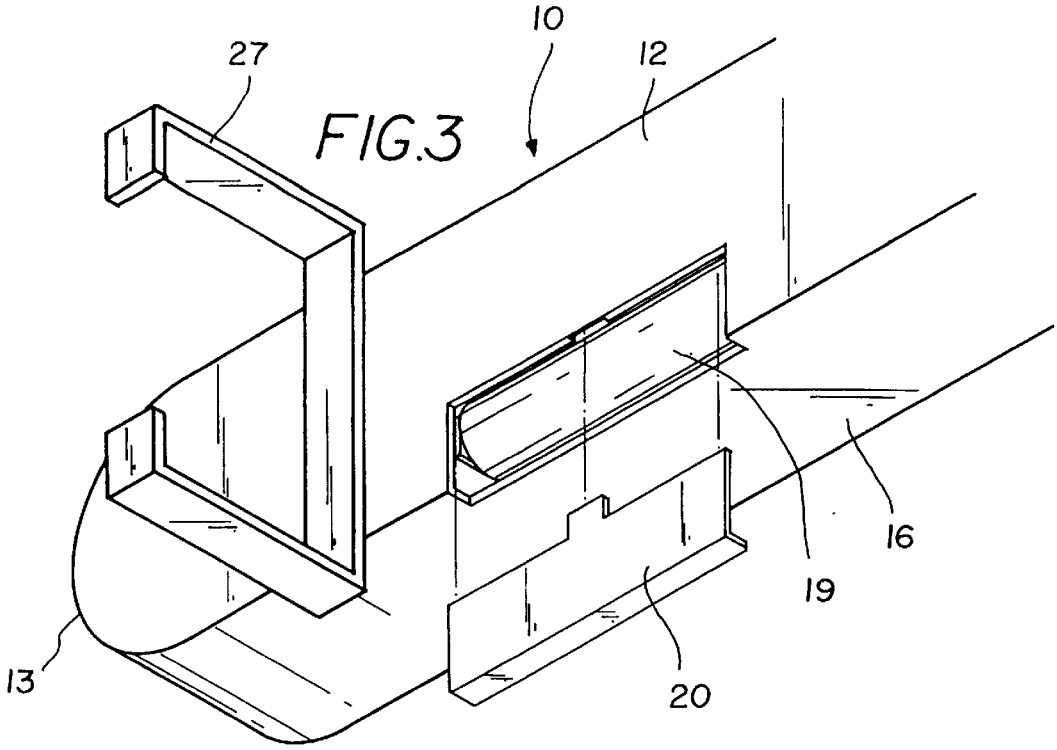
FIG. 3 is a schematic perspective view of the rear of one embodiment of the present invention.

A battery power source 19 is disposed in the housing and is electrically connected to each of the light sources. The housing preferably has a removable access panel for providing access to the battery power source in the housing. As illustrated in FIG. 3, the access panel is preferably located in the back face of the housing adjacent the bottom side of the housing.

A sequence controller 21 is provided in the housing and is electrically connected to each of the light sources for controlling a sequence of illumination that the light sources are illuminated. Each of the light sources has a switch 22*a*,22*b*,22*c*,22*d*,22*e* electrically connected thereto between the sequence controller and the respective light source. These switches are also preferably electrically connected to the respective light source between the battery power source and the respective light source.

In use, the sequence controller generates a sequence of signals. Each signal is directed to the switch of one of the light source. Each switch is thrown closed to thereby activate the associated light source upon receipt of a corresponding signal from the sequence controller and is thrown open to thereby deactivate the light source upon the generation of the subsequent signal of the series of signal generated by the sequence controller so that the light sources are illuminated and then deactivated by the sequence of the signals generated by the sequence controller. Preferably, the order in which the light sources are illuminated in the sequence of illumination by the sequence controller is random. In such an embodiment, the sequence controller preferably has a randomizer for generating a random series of signals in the series of signals generated by the sequence controller so that the light sources are illuminated in a random order.

An activation switch 23 is electrically connected to the sequence controller and has a push button actuator 24 mounted on the front face of the housing. Preferably, the push button actuator comprises a resiliently deformable rubber or plastic material. In use, the activation switch selectively controls activation and deactivation of the sequence controller and thereby illumination of the light sources upon depression of the push button actuator.

Optionally, a sound playback device with a speaker may be provided in the housing and electrically connected to the battery power source and the activation source to play a melody when the activation switch is actuated.

Figure 4:
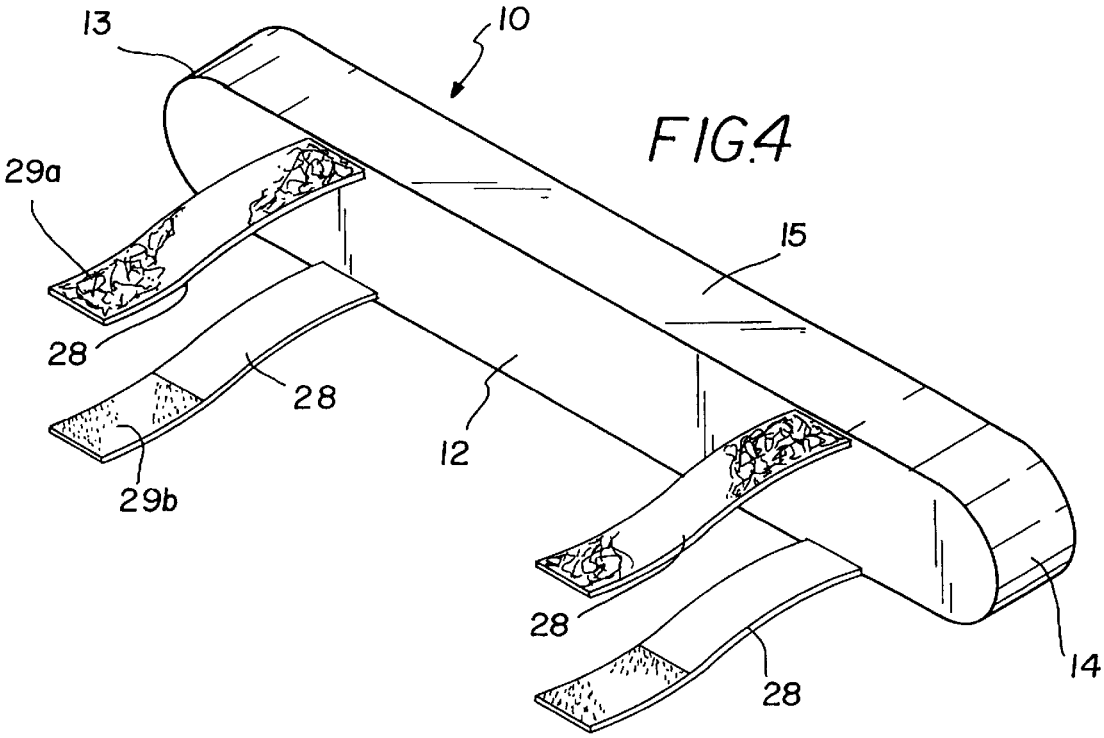
FIG. 4 is a schematic perspective view of the rear of another embodiment of the present invention.
Figure 5:
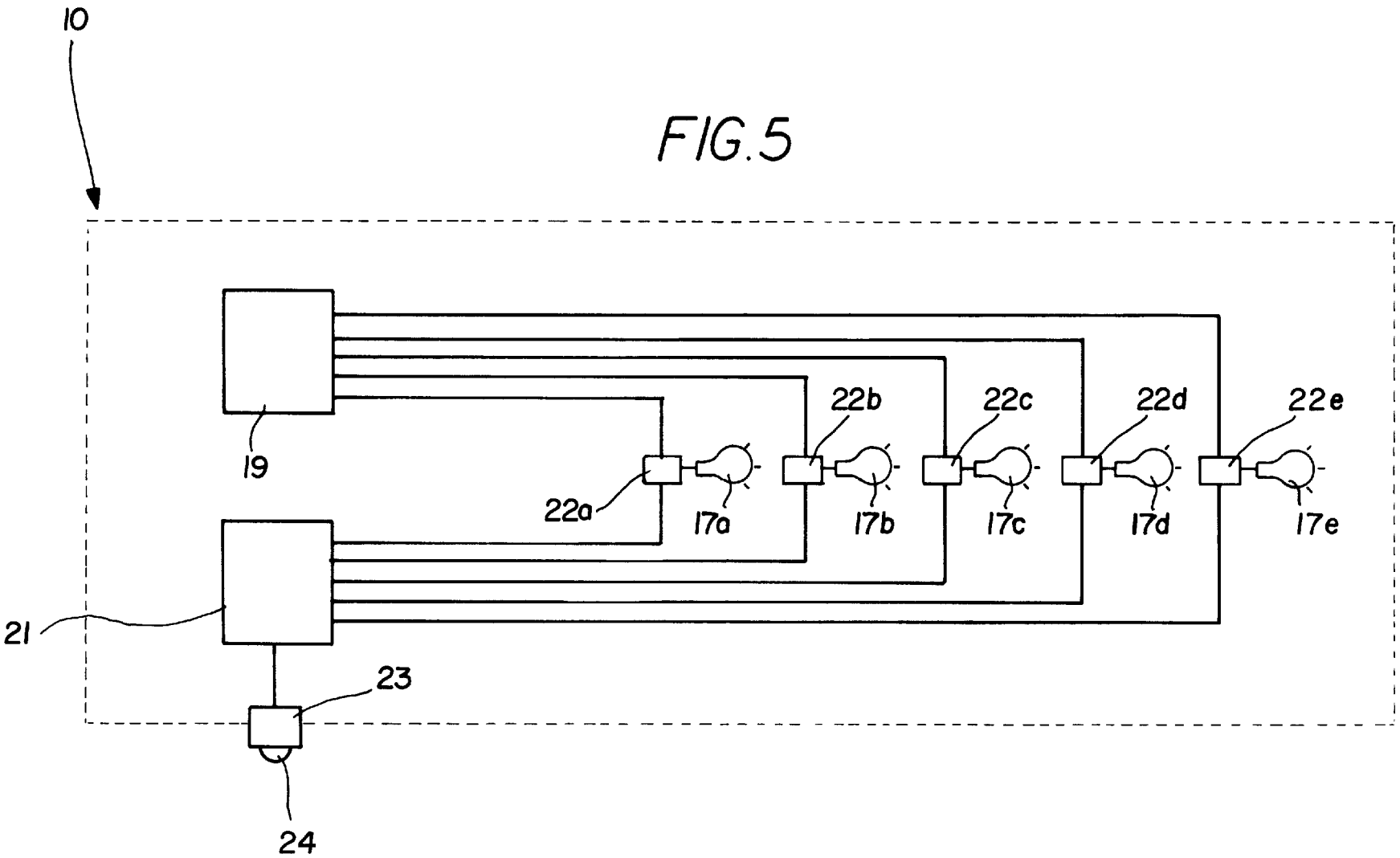
FIG. 5 is an electrical schematic of the present invention.

In use, the housing is designed for mounting to a pivotally mounted carry handle 25 of an infant carrier 26 such that the front face of the housing faces in a direction towards the location of the head of an infant in the infant carrier. With reference to FIG. 3, in one preferred embodiment, the housing has a spaced apart pair of resilient and generally rectangular-C-shaped clips 27 coupled to the back face of the housing that may be disposed around the carry handle to mount the housing to the carry handle. In another preferred embodiment as illustrated in FIG. 4, the housing may have a plurality of fastening straps 28 outwardly extending from the back face of the housing. The fastening straps are wrapped around the carry handle of the infant carrier. Preferably, the plurality of straps comprise first and second pair of straps with the straps of each pair being detachably coupled to one another by a hook and loop fastener 29*a*,29*b*. Optionally, the housing may integrally formed into the carry handle of the infant carrier.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An amusement device system comprising:

an infant carrier having a carry handle for gripping by a hand of a user;

a housing removably mounted to said carry handle of an infant carrier, said housing being elongate to permit gripping of said carry handle of said carrier along with said housing, said housing having opposite ends, front face and a back face;

said housing having a plurality of spaced apart light sources therein positioned on said front face of said housing;

said housing having a pair of mounting structures longitudinally spaced along a length of the housing adjacent said ends for engaging spaced locations of said carry handle of said infant carrier, each of said mounting structures permitting removable mounting of said housing to said carry handle, each of said mounting structures being mounted on the back face of the housing for directing the plurality of lights on said front face toward an infant in said infant carrier when the mounting structures are mounted on said carry handle; and a sequence controller being disposed in said housing and being electrically connected to each of said light sources, said sequence controller illuminating said light sources in a sequential series.

2. The amusement device of claim 1, wherein light sources are located adjacent said front face of said housing.

3. The amusement device of claim 2, wherein said front face of said housing has a plurality of translucent windows, each light source being positioned adjacent a corresponding window.

4. The amusement device of claim 3, wherein each of said windows is tinted a color, and wherein said color of each window is visually distinguishable from the colors of the other windows.

5. The amusement device of claim 3, wherein said windows each have a generally circular outer perimeter, and wherein said windows are arranged in a row on said front face of said housing extending between said ends of said housing, and wherein said windows have centers coaxially aligned with one another in said row.

6. The amusement device of claim 3, wherein a first window is tinted a red color, a second window is tinted a blue color, a third window is tinted a green color, a fourth window is tinted a orange color, and a fifth window is tinted a yellow color.

7. The amusement device of claim 1, wherein each of said light sources has a switch electrically connected thereto between said sequence controller and the respective light source, wherein said sequence controller generates a sequence of signals wherein each signal is directed to said switch of one of said light source, wherein each switch activates the associated light source upon receipt of a corresponding signal from said sequence controller and deactivate the light source upon the generation of the subsequent signal of the series of signal generated by said sequence controller so that the light sources are illuminated and then deactivated by the sequence of the signals generated by the sequence controller.

8. The amusement device of claim 7, wherein said order in which said light sources are illuminated in said sequence of illumination by said sequence controller is random.

9. The amusement device of claim 1, wherein an activation switch is electrically connected to said sequence controller and has a push button actuator mounted on said housing.

10. An amusement device system, comprising:

an elongate housing having front and back faces, a pair of opposite ends and top and bottom sides extending between said ends of said housing;

said front and back faces of said housing lying in substantially parallel planes with one another;

said top and bottom sides of said housing lying in substantially parallel planes with one another substantially perpendicular to said planes of said front and back faces of said housing;

said ends of said housing being rounded and having concavities facing one another;

said front face of said housing having a plurality of spaced apart light sources therein;

said front face of said housing having a plurality of translucent windows, each light source being positioned adjacent a corresponding window;

said windows each having a generally circular outer perimeter;

said windows being arranged in a row on said front face of said housing extending between said ends of said housing, said windows having centers coaxially aligned with one another in said row;

each of said windows being tinted a color, said color of each window being visually distinguishable from the colors of the other windows;

wherein a first window is tinted a red color, a second window is tinted a blue color, a third window is tinted a green color, a fourth window is tinted a orange color, and a fifth window is tinted a yellow color;

a battery power source being disposed in said housing and being electrically connected to each of said light sources;

said housing having a removable access panel for providing access to said battery power source in said housing, said access panel being located in said back face of said housing adjacent said bottom side of said housing;

a sequence controller being disposed in said housing and being electrically connected to each of said light sources;

each of said light sources having a switch electrically connected thereto between said sequence controller and the respective light source, said switches being electrically connected to the respective light source between said battery power source and the respective light source;

said sequence controller generating a sequence of signals wherein each signal is directed to said switch of one of said light source, each switch activating the associated light source upon receipt of a corresponding signal from said sequence controller and deactivating the light source upon the generation of the subsequent signal of the series of signal generated by said sequence controller so that the light sources are illuminated and then deactivated by the sequence of the signals generated by the sequence controller;

wherein said order in which said light sources are illuminated in said sequence of illumination by said sequence controller is random;

an activation switch being electrically connected to said sequence controller and having a push button actuator mounted on said front face of said housing, wherein said push button actuator comprises a resiliently deformable material;

an infant carrier having a carry handle pivotally coupled thereto; and said housing being mounted to said carry handle of said infant carrier.

11. The amusement device system of claim 10, wherein said housing has a spaced apart pair of resilient and generally rectangular-C-shaped clips coupled to said back face of said housing, said clips being disposed around said carry handle to mount said housing to said carry handle.

12. The amusement device system of claim 10, wherein said housing has a plurality of fastening straps outwardly extending from said back face of said housing, said fastening straps being wrapped around said carry handle of said infant carrier.

13. An amusement system, comprising:

an infant carrier having a carry handle for gripping by a hand of a user;

an housing removably mounted on the carry handle of said infant carrier for viewing by an infant in said carrier, said housing being elongate to permit gripping of said carry handle of said carrier along with said housing;

said housing having a plurality of spaced apart light sources therein; and a sequence controller being disposed in said housing and being electrically connected to each of said light sources, said sequence controller illuminating said light sources in a sequential series.

14. The amusement device of claim 13, wherein light sources are located adjacent a front face of said housing.

15. The amusement device of claim 14, wherein said front face of said housing has a plurality of translucent windows, each light source being positioned adjacent a corresponding window.

16. The amusement device of claim 15, wherein each of said windows is tinted a color, and wherein said color of each window is visually distinguishable from the colors of the other windows.

17. The amusement device of claim 15, wherein said windows each have a generally circular outer perimeter, and wherein said windows are arranged in a row on said front face of said housing extending between said ends of said housing, and wherein said windows have centers coaxially aligned with one another in said row.

18. The amusement device of claim 13, wherein each of said light sources has a switch electrically connected thereto between said sequence controller and the respective light source, wherein said sequence controller generates a sequence of signals wherein each signal is directed to said switch of one of said light source, wherein each switch activates the associated light source upon receipt of a corresponding signal from said sequence controller and deactivate the light source upon the generation of the subsequent signal of the series of signal generated by said sequence controller so that the light sources are illuminated and then deactivated by the sequence of the signals generated by the sequence controller.

19. The amusement device system of claim 1, wherein each of said mounting structures comprises a resilient and generally rectangular-C-shaped clip coupled to a back face of said housing, said clips being disposable about said carry handle for mounting said housing to said carry handle.

20. The amusement device system of claim 1, wherein each of said mounting structures comprises a fastening strap outwardly extending from a back face of said housing, said fastening straps being wrappable around the carry handle of said infant carrier for mounting said housing to said carry handle.

* * * * *